United States Patent [19]

Enomoto et al.

[11] 4,410,222

[45] Oct. 18, 1983

[54] ELECTRICAL CONNECTOR FOR A RIBBON CABLE

[75] Inventors: Masahiro Enomoto, Kawasaki; Yoshiyuki Awano, Sagamihara; Yuji Yamada; Akira Aso, both of Yokohama, all of Japan

[73] Assignee: Molex Incorporated, Lisle, Ill.

[21] Appl. No.: 280,706

[22] Filed: Jul. 6, 1981

[30] Foreign Application Priority Data

Jul. 5, 1980 [JP] Japan ..... 55-91238

[51] Int. Cl.[3] ..... H01R 23/54

[52] U.S. Cl. ..... 339/17 F; 339/45 M; 339/99 R; 339/103 M

[58] Field of Search ..... 339/97 R, 97 P, 98, 339/99, 75 M, 91 R, 103 R, 103 M, 45 R, 45 M, 17 F

[56] References Cited

U.S. PATENT DOCUMENTS 3,820,055 6/1974 Huffnagle et al. ..... 339/97 P
4,088,382 5/1978 Ichimura ..... 339/99 R
4,214,800 7/1980 Hollyday et al. ..... 339/45 M
4,241,966 12/1980 Gomez ..... 339/75 M

FOREIGN PATENT DOCUMENTS 52-3185 11/1977 Japan ..... 339/99 R

*Primary Examiner*—John McQuade
*Attorney, Agent, or Firm*—Louis A. Hecht

[57] ABSTRACT

An electrical connector assembly for electrically connecting insulation-clad ribbon cable to a circuit member. The connector assembly includes a female connector, which is connected to the ribbon cable, and a male connector or header, which is connected to said circuit member, and is adapted to mate with the female connector. Selectively removeable strain relief means are provided as part of the female connector. The male connector has a pair of improved, pivotly mounted manually manipulatable lever means for selectively ejecting or locking the female connector with the male connector. The lever means can positively lock and mate the female connector to the male connector whether or not the strain relief means is mounted on the female connector.

4 Claims, 14 Drawing Figures

ELECTRICAL CONNECTOR FOR A RIBBON CABLE

BACKGROUND OF THE INVENTION

1. Field of the Invention

The present invention is directed to the field of interconnecting ribbon cable to a printed circuit board or other circuit member where a female connector is connected to the ribbon cable and a mating header or male connector is connected to the other circuit member and, more particularly, to devices for locking and ejecting the connectors with one another.

2. Brief Description of the Prior Art

Electrical connector assemblies of the type described are well known in the art and have a male connector with features in order to assist the mating of the male and female connectors with one another. In particular, it is desirable that such a feature be able to retain the female connector in mating relationship with the male connector or, selectively, eject the female connector from the male connector.

Very often the female connector is provided with strain relief means in order to prevent accidental removable of the ribbon cable therefrom. The strain relief adds height to the female connector because it is mounted thereover. Because of this, any latch/eject means would have to be custom-made for the particular female connector to be used. That is, the male connector would have to be provided with a different dimensioned latch/eject means for a female connector by itself as compared with a female connector having a strain relief mounted thereon.

One attempt to overcome this problem is disclosed in U.S. Pat. No. 4,241,966. This patent provides for a means of retaining connectors of different heights in the same male connector or header. However, the means disclosed in U.S. Pat. No. 4,241,966 presents a relatively high profile and does not offer a compact, positive retaining feature.

SUMMARY OF THE INVENTION

It is, therefore, the principal object of the present invention to provide a more compact, positive locking latch/eject means on the male connector of an electrical connector assembly for electrically connecting insulation-clad ribbon cable to a circuit member. The electrical connector assembly includes a female connector electrically connected to the ribbon cablwe, selectively removeable strain relief means mountable over said female connector, and a male connector mounted on said circuit member for mating with said female connector, said male connector including a pair of pivotly mounted manually manipulatable lever means movable between a locking position and a eject position for selectively locking and ejecting the female connector to and from the male connector, each lever means including an eject portion underlying and engaging the underside of the female connector and a locking portion adapted to simultaneously overlie and engage the female connector when in a locking position. The improvement comprising the invention resides in that the locking portion of each lever means includes a gripping portion having two spaced apart walls depending therefrom defining a cavity for receiving and surrounding an end of the strain relief means, said walls having a bottom surface for engaging the top of the female connector when the lever means is in the locking position regardless of whether the strain relief means is mounted thereon.

DESCRIPTION OF THE PREFERRED EMBODIMENT

Figure 1:
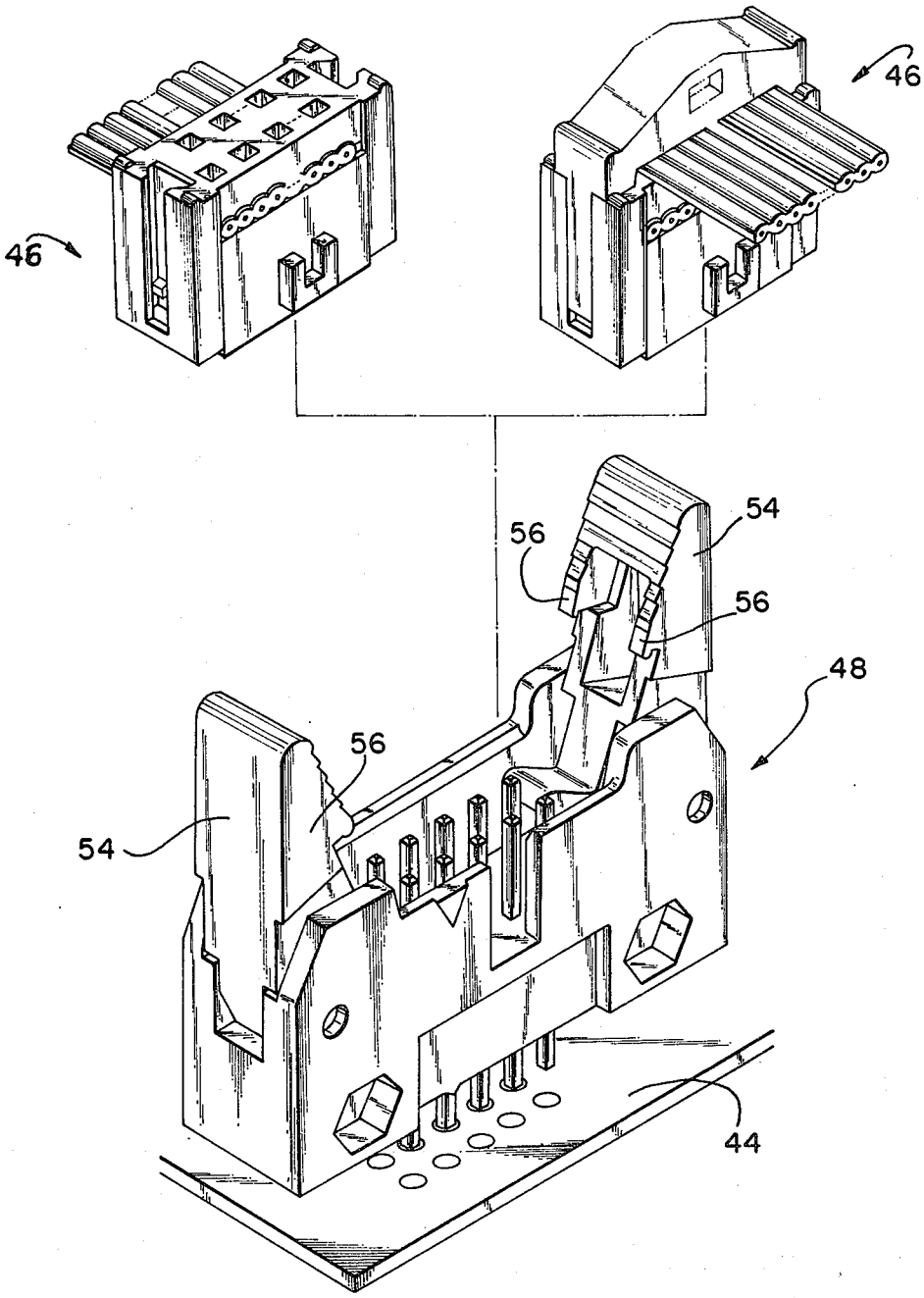
FIG. 1 is an exploded perspective view of an enlarged male connector and two optional female connectors, one with a strain relief means and the other without.

Turning now to FIG. 1, the connector assembly of the present invention is used for electrically connecting insulation-clad ribbon cable 16 to a circuit member such as a printed circuit board 44. The connector assembly includes a female connector, generally designated 46, which is matable with a male connector or header, generally designated 48.

The female connector 46 includes a first housing 14 made of insulative material with a plurality of terminal receiving cavities 50 formed therein. Each cavity 50 has a pin receiving opening 13 formed in the underside 40 and top opening 52.

Figure 3:
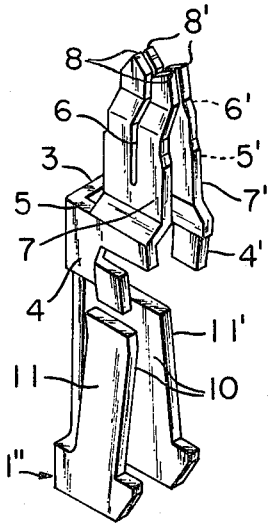
FIG. 3 is an enlarged perspective view of a terminal mounted in the female connector comprising a part of the connector assembly of the present invention.
Figure 4:
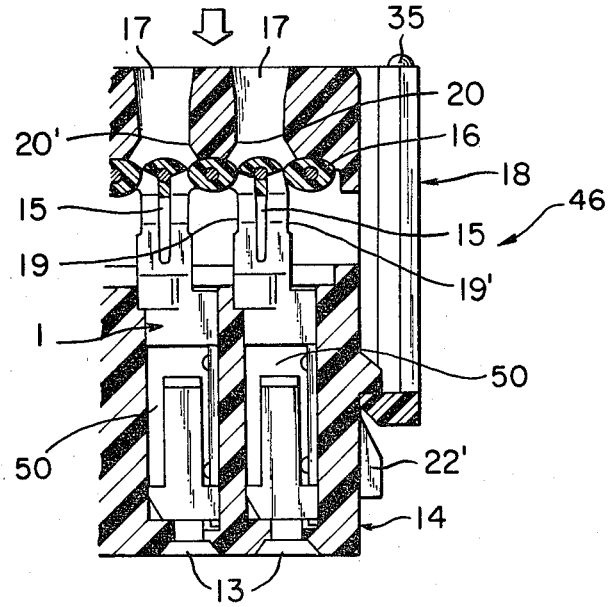
FIG. 4 is a side sectional view of the female connector comprising the part of the connector assembly of the present invention immediately prior to mating with ribbon cable conductors.

A plurality of terminals, generally designated 1, are received in the terminal receiving cavities 50. As best shown in FIG. 3, each terminal 1 has a pin receiving portion 10 formed by a pair of spring plates 11 and 11'. The opposite end of each terminal 1 has an insulation displacement portion which is defined by a pair of opposing plates 4 having outer edges 5 and a conductor receiving groove or slots 6 formed between a pair of arms 7 and 7'. The arms have pointed tip end 8 and 8'. A body portion 3 connects the insulation displacement portion with the pin receiving portion of each terminal 1.

Figure 2:
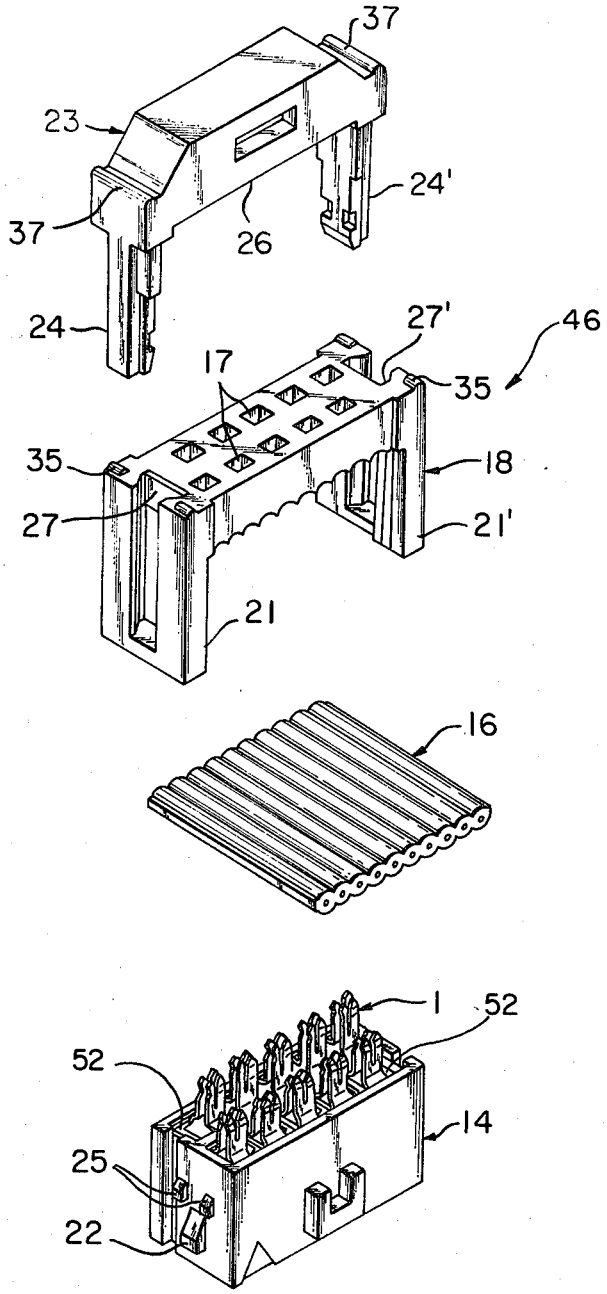
FIG. 2 is an exploded perspective view of a female connector comprising a part of the electrical connector assembly of the present invention.
Figure 5:
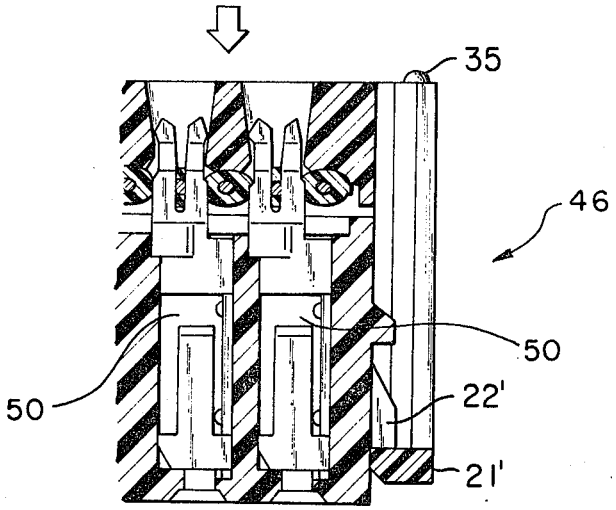
FIG. 5 is a fragmentary side sectional view of the female connector comprising the part of the connector assembly of the present invention immediately prior to mating with ribbon cable conductors.
Figure 6:
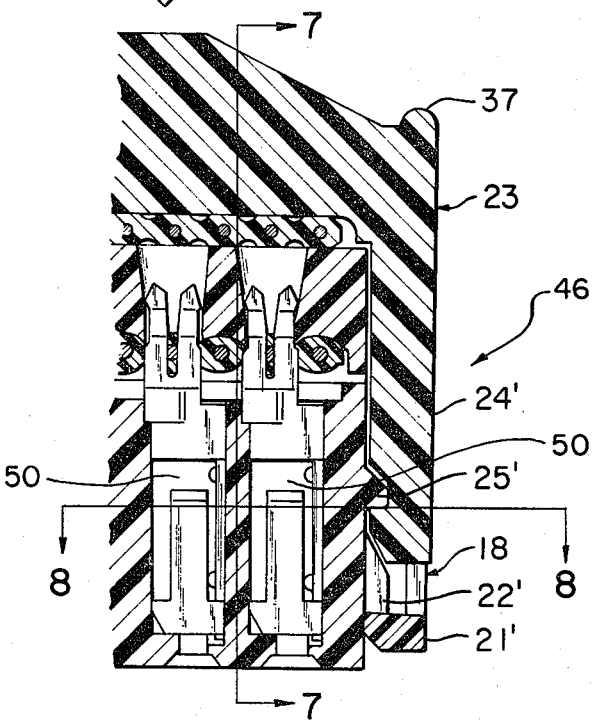
FIG. 6 is a fragmentary side sectional view similar to FIG. 5 with strain relief means mounted on and forming the part of the female connector.
Figure 7:
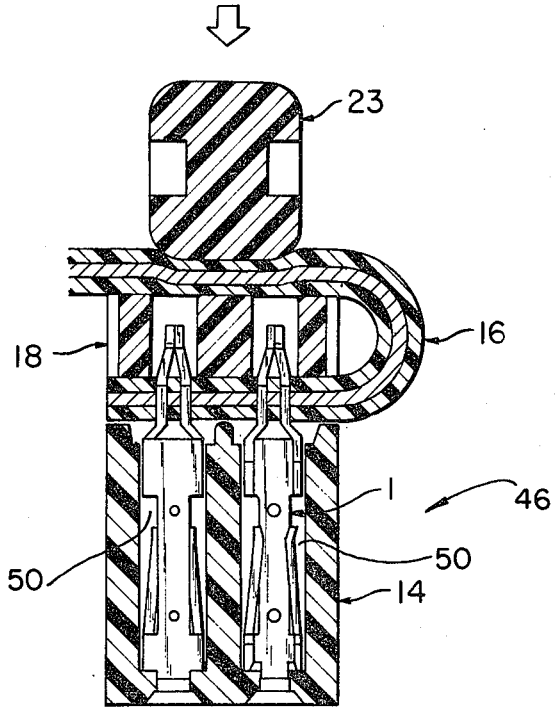
FIG. 7 is a sectional view taken generally along the line 7—7 of FIG. 6.

Looking at FIG. 2, the female connector 46 also has a second housing 18 which is adapted to be mounted above the first housing 14. The second housing 18 has a plurality of holes 17 formed therein. Each hole 17 is adapted to receive the top of the insulation displacement portion of the corresponding terminal 1 when the second housing is mounted on the first housing (FIGS. 5–7).

Figure 8:
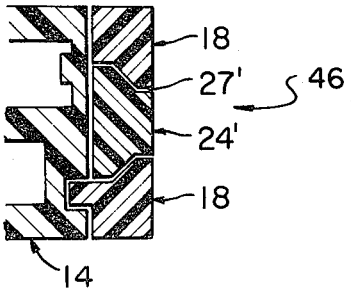
FIG. 8 is a sectional view taken generally along the line 8—8 of FIG. 6.

The ribbon cable 16 is adapted to be received between the first housing 14 and the second housing 18 and to be retained therebetween by first interengaging means cooperating between the first housing and the second housing. The first interengaging means is seen to generally include locking arms 21 depending from the second housing 18 which are adapted to mate with a pair of projections 22 extending from either side of the first housing 14. Each locking arm 21 has a dove tail open-slotted groove 27, 27′ (FIGS. 2 and 8) formed therein for reasons which will become more apparent hereinafter.

The female connector 46 has provision for mounting a strain relief means, generally designated 23, over the second housing 18. The strain relief means 23 includes a bar member 26 which is generally parallel to and spaced from the second housing 18. A portion of the ribbon cable 16 is receivable between the bar member 26 and the top of the second housing 18.

In order to mount the strain relief means 23, second interengaging means are provided for selectively mounting and locking the strain relief means onto the female connector after the ribbon cable 16 has been placed between bar member 26 and the second housing 18. In this manner, the ribbon cable 16 is clamped between the bar member 26 and second housing 18. More particularly, the second interengaging means is seen to generally include two locking legs 24 and 24′ depending from the bar member 26 as seen in FIG. 2. The locking legs 24 and 24′ are adapted to be received within the dove tail grooves 27 of the locking arms 21 and 21′ respectively, to engage two pairs of projections 25 extending from opposite sides of the first housing 14 as best shown in FIGS. 2 and 6.

The male connector or header 48 is mounted on the printed circuit board 44 and is adapted to mate with the female connector 46. The male connector 48 is seen to generally include an insulator 29 having a plurality of pins 9 mounted therein and extending on either side thereof. The ends 30 of the pins 9 on one side of the insulator 29 are adapted to be received through the bottom openings 13 in the first housing 14 to contact the pin receiving portion 10 of each terminal 1. The other ends 28 of the pins 9 are adapted to be electrically connected to the printed circuit board 44.

Figure 9:
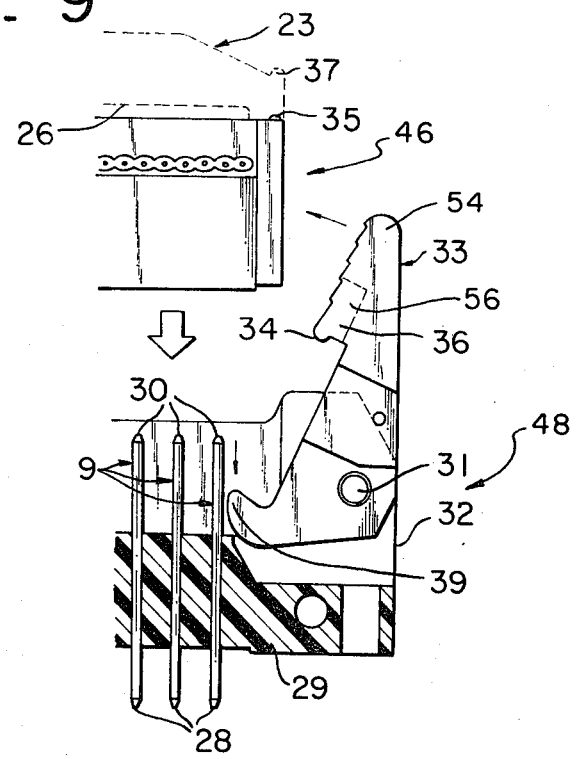
FIG. 9 is a partial side sectional view of the connector assembly of the present invention prior to the mating of the female and male connectors.
Figure 10:
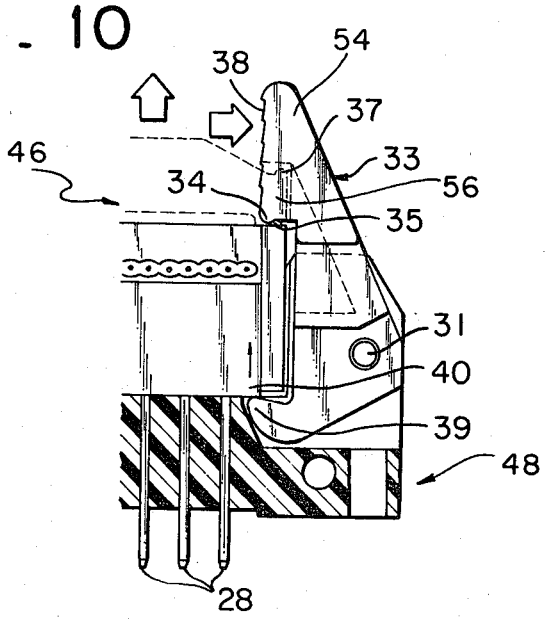
FIG. 10 is a partial side sectional view of the connector assembly of the present invention with the male and female connectors in mating relationship and the lever means in its locked position.
Figure 11:
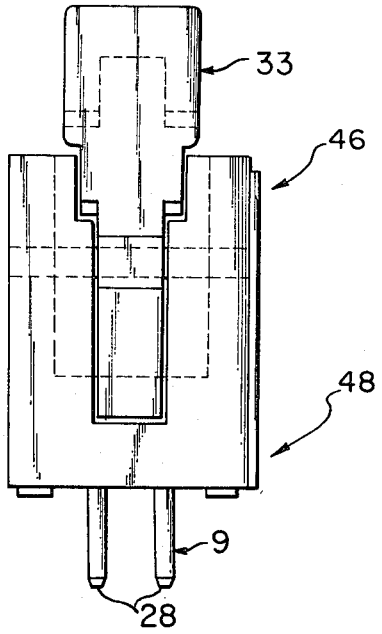
FIG. 11 is a side view of a fully mated electrical connector of the present invention.

The male connector 48 also includes a pair of pivotably mounted manually manipulatable lever means 33 which are mounted on a pair of shafts 31 within the insulator 29. Each lever means 33 are movable between a locking position as is shown in FIG. 10 and an eject position which is shown in FIG. 9 for selectively locking and ejecting the female connector 46 to and from the male connector 48. Each lever means 33 includes an eject portion 39 which underlies and engages the underside 40 for the first housing 14 and the locking portion 54 that is adapted to simultaneously overlie and engage the second housing 18 and the strain relief means 23 when in a locking position.

The locking portion 54 of each lever means 33 includes a gripping portion 38 having two spaced apart walls 56 depending therefrom defining a cavity or groove 36 for receiving and surrounding an end of the strain relief means 23. As shown in FIGS. 6, 9 and 10, the strain relief means 23 is formed at each end with an upwardly projecting crown 37. As the lever means 33, 33 are pivoted into their locking positions, the crowns 37, 37 are engaged by the upper surfaces of the cavities or grooves 36, 36 facilitating the drawing together of the strain relief means 23, the female housing 46 and the male housing 48. The walls 56 have a bottom surface 34 for engaging the top of the second housing 18 of the female connector 46 when the lever means 33 is in the locking position regardless of whether the strain relief means 23 is mounted thereon and forms a part of the female connector. Preferably, as shown in FIGS. 9 and 10, the bottom surfaces 34, 34 of the walls 56, 56 are formed with a downwardly projecting arcuate shape. Correspondingly, hemispherical protrusions 35, 35 are provided at each corner of the upper surface of the second housing 18 and are appropriately positioned so that, upon pivotal movement of a latching lever 33 into locking engagement with the second housing 18, each arcuate surface 34 of the latching lever 33 engages a respective protrusion 35, thereby facilitating positive retention of the latching lever 33 in locking relationship with the second housing 18 of the female connector 46.

Because of the fit between the locking portion 54 and the female connector 46, three results occur:

1. the same dimensioned or sized lever means 33 can be used whether or not a strain relief means 23 is employed; and 2. the overall height of the connector assembly, which is dictated by the length of the lever means 33, is lower because the strain relief means 23 is receivable within the cavity or groove 36; and 3. because the walls 56 surround the strain relief means 33, there is a better positive retention of the female connector 46 within the male connector 48 and of the strain relief means 23.

We claim:

1. An electrical connector assembly for electrically connecting insulation-clad ribbon cable to a circuit member, said electrical connector assembly including a female connector electrically connected to the ribbon cable, selectively removeable strain relief means mountable over said female connector, and a male connector mounted on said circuit member for mating with said female connector, said male connector including a pair of pivotably mounted manually manipulatable lever means moveable between a locking position and an eject position for selectively locking and ejecting the female connector to and from the male connector, each lever means including an eject portion underlying and engaging the underside of the female connector and a locking portion adapted to simultaneously overlie and engage the female connector when in a locking position, the improvement comprising:

the locking portion of each lever means including a gripping portion having two spaced apart walls depending therefrom defining a cavity for receiving and surrounding an end of the strain relief means, each of said walls having a bottom surface for engaging the top surface of the female connector when the lever means is in the locking position regardless of whether the strain relief means is mounted thereon.

2. The connector assembly of claim 1 wherein said female connector includes a first housing made of insulative material with a plurality of terminal receiving cavities formed therein, each cavity having a bottom pin receiving opening and a top opening, a plurality of terminals, each one received in a corresponding terminal receiving cavity, each terminal including a pin receiving portion mounted within the terminal receiving cavity and an insulation displacement portion extending above the top opening of the terminal receiving cavity adapted to electrically contact the ribbon cable by piercing and displacing the insulation therearound, a second housing adapted to be mounted above the first housing, said second housing including a plurality of holes formed therein, each hole adapted to receive the top of the insulation displacement portion of the corresponding terminal when the second housing is mounted on the first housing, and first interengaging means cooperating between the first housing and second housing for selectively mounting and locking the second housing on the first housing after the ribbon cable has been placed therebetween in alignment with said terminals, whereby the ribbon cable electrically contacts said terminals when said second housing is mounted on said first housing;

wherein said strain relief means includes a bar member generally parallel to and spaced from the second housing, a portion of said ribbon cable being receivable between said bar member and the top of said second housing, and second interengaging means cooperating between said strain relief means and said second housing for selectively mounting and locking the strain relief means on the second housing after the ribbon cable has been placed between the bar member and second housing, whereby the ribbon cable is clamped between the bar member and second housing when said strain relief means is mounted on said second housing; and wherein said male connector includes an insulator, and a plurality of pins mounted in said insulator extending on either side thereof, the ends of the pins on one side of the insulator being adapted to be received through the bottom openings in the first housing to contact the pin receiving portion of each terminal and the other ends of the pins being adapted to be electrically connected to said circuit member.

3. The connector assembly of claim 2 wherein said first interengaging means includes a depending locking arm at each end of the second housing for engagement with a projection on an end of the first housing, and wherein second interengaging means includes a depending locking leg at each end of the bar member of the strain relief means for engagement with two projections on a side of the first housing, said locking arms having dove tail grooves of trapezoidal cross-section for slidingly receiving the locking legs and each of said locking legs being engageable with said two projections within said groove of said locking arms.

4. The connector assembly of claim 2 wherein the bar member of the strain relief means is narrower in width than the female connector to allow the bottom surface of the gripping portion walls to engage the top surface of the second housing of the female connector.

* * * * *